US006418826B1

(12) United States Patent
Suzuki et al.

(10) Patent No.: US 6,418,826 B1
(45) Date of Patent: Jul. 16, 2002

(54) APPARATUS FOR SLICING COMPRESSION MOLDED PRODUCT OF SHEET-SHAPED MATERIAL AND SPLIT KNIFE

(75) Inventors: Kazuyuki Suzuki; Yoshihiro Yamazaki; Koji Shimada, all of Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 223 days.

(21) Appl. No.: 09/029,935

(22) PCT Filed: Jul. 10, 1997

(86) PCT No.: PCT/JP97/02398

§ 371 (c)(1),
(2), (4) Date: Mar. 10, 1998

(87) PCT Pub. No.: WO98/02052

PCT Pub. Date: Jan. 22, 1998

(30) Foreign Application Priority Data

Jul. 11, 1996 (JP) ..... 8-182125

(51) Int. Cl.[7] ..... B26D 7/06

(52) U.S. Cl. ..... 83/111; 83/158; 83/699.11; 83/636; 30/357

(58) Field of Search ..... 83/931, 943, 111, 83/699.11, 155, 158, 636; 30/357, 356

(56) References Cited

U.S. PATENT DOCUMENTS 625,289 A * 5/1899 Christie ..... 83/636
2,542,527 A * 2/1951 Gyuris ..... 83/111
3,046,825 A * 7/1962 Thompson ..... 83/699.11
5,078,036 A 1/1992 Ray
5,231,908 A * 8/1993 Skvarce et al. ..... 83/699.11
5,435,218 A * 7/1995 Martin ..... 83/931
5,529,130 A * 6/1996 Suk ..... 30/357

FOREIGN PATENT DOCUMENTS

| | | | |
|---|---|---|---|
| EP | 0159836 A1 | 10/1985 | |
| JP | 4426390 | 11/1969 | |
| JP | 494395 | 1/1974 | |
| JP | 58220679 | 12/1983 | |
| JP | 0325036 | * 7/1989 | ..... 83/111 |
| JP | 2504108 | 11/1990 | |
| JP | 038140 A | 2/1996 | |

* cited by examiner

*Primary Examiner*—Allan N. Shoap
*Assistant Examiner*—Thomas J Druan, Jr.
(74) *Attorney, Agent, or Firm*—Birch, Stewart, Kolasch & Birch, LLP

(57) ABSTRACT

A slicing apparatus for dividing a compression-molded article of laminae is provided with a dividing knife that reciprocates within a horizontal plane, and the dividing knife has a cutting edge in the shape of a V directed toward the compression-molded article, and cuts into the compression-molded article while holding the article from both sides.

17 Claims, 10 Drawing Sheets

APPARATUS FOR SLICING COMPRESSION MOLDED PRODUCT OF SHEET-SHAPED MATERIAL AND SPLIT KNIFE

This application claims the benefit under 35 U.S.C. §371 of prior PCT International Application No. PCT/JP97/02398 which has an International filing date of Jul. 10, 1997 which designated the United States of America, the entire contents of which are hereby incorporated by references.

TECHNICAL FIELD

The present invention relates to a slicing apparatus for dividing a molded article, obtained by stacking and compressing sheet-like materials, to a given thickness, and more particularly, to a slicing apparatus and a dividing knife adapted for the manufacture of tobacco materials.

BACKGROUND ART

Reaped leaf tobacco is separated into laminae and stems after it is classified according to breeds, grades, etc. Laminae of the same breed and grade are stacked in layers as they are stored in a container, such as a corrugated cardboard box, barrel, etc., and these stacked laminae are compressed in the container to form a compression-molded article. Thereafter, the compression-molded article in the container is preserved or matured for a given period.

When the maturation is completed, the compression-molded article of laminae is taken out from the container onto a lifter, and is horizontally divided into slice pieces with a given thickness. This slicing of the compression-molded article is carried out to obtain an aggregation of slice pieces in accordance with given blending ratios between slice pieces obtained from various compression-molded articles. Since the individual slice pieces are small, moreover, the compressed laminae in each slice piece can be easily untied, so that subsequent moisture conditioning and scenting processes for the laminae can be carried out satisfactorily.

For example, a slicing apparatus disclosed in Jpn. Pat. Appln. KOKAI Publication No. 8-38140 is used to slice the aforesaid compression-molded articles of laminae. This known slicing apparatus is provided with a dividing knife, and this dividing knife can reciprocate within a horizontal plane, and has a chevron-shaped edge that projects toward the compression-molded article. When the dividing knife moves toward the compression-molded article, the dividing knife cuts into the compression-molded article with the top portion of its chevron-shaped edge forward, thereby horizontally slicing the compression-molded article.

As the aforesaid dividing knife cuts into the compression-molded article, the chevron-shaped dividing knife advances in the compression-molded article with the central portion of its edge ahead of the opposite ends. During the slicing operation, therefore, the dividing knife subjects the compression-molded article to a force directed from the inside toward the outer periphery of the compression-molded article. This force causes the outer periphery of the compression-molded article to chip. Accordingly, slice pieces cannot be satisfactorily cutout of the compression-molded article, and it is hard to stabilize the size of the slice pieces.

If cleavage in the compression-molded article occurs in front of the edge of the dividing knife during the slicing operation, moreover, this cleavage makes it impossible to cut out slice pieces with a uniform thickness throughout the area. More specifically, in connection with this, the compression-molded-article in the container, which is subjected to the compression, has its central portion recessed, and the compression-molded article is held upside down as it is taken out of the container. Thus, the compression-molded article on the lift is upwardly convex. If cleavage in this compression-molded article occurs in front of the edge of the dividing knife, that portion of the article above the cleavage lifts as the dividing knife cuts in. As a result, the dividing knife inevitably slices the compression-molded article at a portion under a target slice surface.

Furthermore, the generally known slicing apparatus described above is suited for the small-lot production of cigarettes or filter cigarettes, and is not for large-lot production.

DISCLOSURE OF THE INVENTION

The object of the present invention is to provide a slicing apparatus and a dividing knife thereof, suited for large-lot production and capable of steadily cutting out slice pieces with a uniform thickness throughout the area from a compression-molded article of sheet materials without causing the outer periphery thereof to chip.

The above object is achieved by a slicing apparatus and a dividing knife according to the present invention. The slicing apparatus is provided with a lifter for receiving a compression-molded article of sheet-like materials, and the lifter raises and lowers the received compression-molded article. The slicing apparatus is further provided with a dividing knife for dividing the compression-molded article on the lifter into pieces with a given thickness and discharge means for discharging the pieces from the surface of the dividing knife to a position beside the dividing knife, and the dividing knife includes an effective cutting edge region recessed with respect to the compression-molded article.

When the dividing knife is moved from its pause position toward the compression-molded article, according to the slicing apparatus described above, the dividing knife cuts into the compression-molded article, whereby a piece of the compression-molded article is formed on the dividing knife. The pieces is discharged from the surface of the dividing knife to the position beside the dividing knife. Thereafter, the dividing knife returns to the pause position, so that the division of the compression-molded article can be repeated after the lifter is further raised for a predetermined distance. Thus, the division of the compression-molded article can be carried out speedily.

The piece discharged from the surface of the dividing knife is fed onto a stack pallet. On this stack pallet, the pieces of various breeds and grades are stacked in layers to form a stack corresponding to a specific brand.

In cutting the compression-molded article, the dividing knife holds the compression-molded article from both sides as it cuts into the compression-molded article, so that the outer periphery of the compression-molded article cannot be broken.

If the upper surface of the compression-molded article is pressed by means of upper presser means when the compression-molded article is cut, cleavage in the compression-molded article can be prevented, and the width of each piece obtained by cutting can be made uniform throughout the area.

If the side face of the compression-molded article is pressed by means of side stopper means when the compression-molded article is cut, there is no possibility of the compression-molded article moving on the lifter as the dividing knife cuts into the compression-molded article.

The effective cutting edge region of the dividing knife may be formed having the shape of a V, W, spread U, or circular arc. With any of these shapes, the effective cutting edge region of the dividing knife can hold the compression-molded article from both sides as it cuts into the compression-molded article.

BEST MODE FOR CARRYING OUT THE INVENTION

Figure 1:
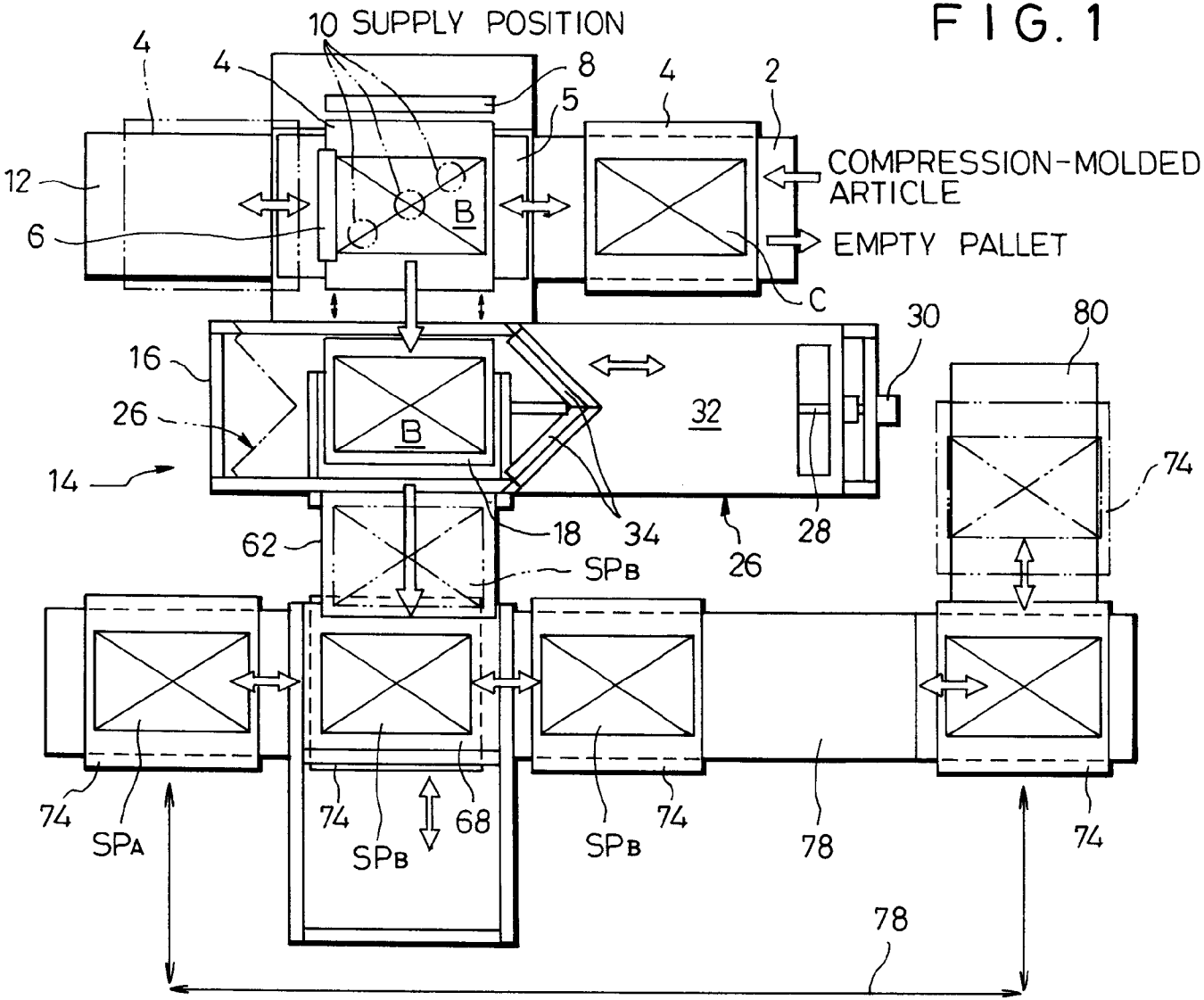
FIG. 1 is a schematic plan view generally showing a compression-molded article slicing/stacking system.

Referring to FIG. 1, a slicing/stacking system is provided with a supply conveyor 2. The supply conveyor 2 extends in the horizontal direction, and is drivable in the forward and reverse directions. The supply conveyor 2 can receive compression-molded articles (A, B, C . . . ) together with pallets 4 at a starting end thereof, and can discharge empty pallets 4 from the starting end.

As mentioned before, each compression-molded article is obtained by stacking laminae of leaf tobacco in layers in a container and then compressing the resulting laminated structure of these laminae. The compression-molded article has the shape of a rectangular parallelepiped, measuring about 600 mm in width, 1,000 mm in length, and 700 mm in height and weighing 100 to 200 kg, for example.

A transfer conveyor 5 is located adjacent to the terminal end of the supply conveyor 2, and the transfer conveyor 5 is formed of a roller conveyor that can be driven in the forward and reverse directions. The transfer conveyor 5 receives the compression-molded article together with the pallet from the supply conveyor 2, and locates the received compression-molded article in a predetermined supply position. For this positioning, a stopper 6 is located above the transfer conveyor 5, and the stopper can move in the moving direction of the transfer conveyor 5 and in the vertical direction. Moreover, the transfer conveyor 5 itself can move in a transverse direction perpendicular to the direction of transfer of the pallet 4. The pallet 4 on the transfer conveyor 5 is fixed by means of fixing means (not shown) when the transfer conveyor 5 moves transversely.

Further, a pusher 8 is located beside the transfer conveyor 5. The pusher 8 is located within the same horizontal plane as the upper surface of the pallet 4 on the transfer conveyor 5, and can reciprocate in a direction perpendicular to the transfer direction of the transfer conveyor 5. More specifically, the pusher 8 is reciprocated as a field screw (not shown) rotates, and this field screw is rotated in the forward and reverse directions by means of a servomotor.

In the state shown in FIG. 1, a compression-molded article B, along with a pallet 4, is situated in the supply position, that is, on the transfer conveyor 5. At this time, the compression-molded article B is in contact with the stopper 6, and the pusher 8 is retreated to a standby position. As shown in FIG. 1, moreover, a next compression-molded article C, along with a pallet 6, is situated on standby on the supply conveyor 2. Here the compression-molded articles B and C are different in the breed and grade of laminae.

Further, sensors 10, e.g., three in number, are arranged over the compression-molded article B that is situated in the supply position. These sensors 10 are movable in the vertical direction, and can individually measure the height of the compression-molded article. As seen from FIG. 1, the three sensors 10 are arranged along a diagonal line of the compression-molded article B, and individually measure the height of the compression-molded article B in the central position and two corner portions of the compression-molded article B.

A standby conveyor 12 adjoins the transfer conveyor 5 on the side opposite from the supply conveyor 2, and an empty pallet 4 can be delivered between the standby conveyor 12 and the transfer conveyor 5.

A slicing apparatus 14 is located near the transfer conveyor 5, that is, on the side opposite from the pusher 8. The slicing apparatus 14 is provided with a main frame 16, and the main frame 16 extends from the supply conveyor 2 to the standby conveyor 12 along them.

Figure 2:
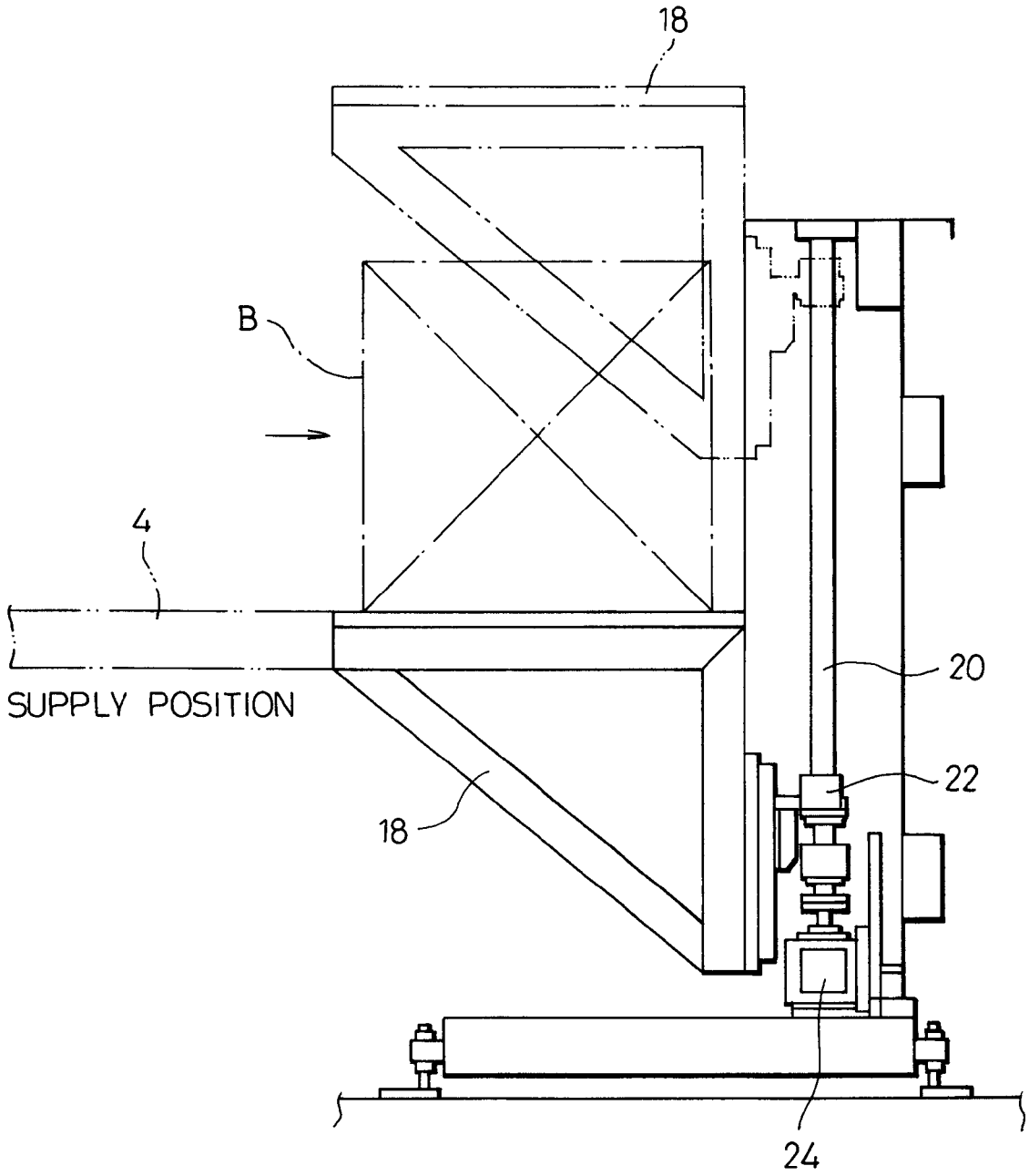
FIG. 2 is a schematic plan view of a slicing apparatus.

A lifter 18 is disposed in the main frame 16, and the lifter 18 is vertically movable in the main frame 16. More specifically, the lifter 18 is slidably supported on a plurality of vertical guide rods (not shown). As shown in FIG. 2, the lifter 18 is coupled to a vertical feed screw 20 by means of a coupling mechanism 22. As the feed screw 20 rotates in the forward and reverse directions, therefore, the lifter 18 can vertically move along the guide rods. A servomotor 24 is connected to the lower end of the feed screw 20, and the servomotor 24 causes the feed screw 20 to rotate. The guide rods and the feed screw 20 are supported on the main frame 16.

When the lifter 18 is situated in the same height position as the pallet 4 on the aforesaid transfer conveyor 5, the transfer conveyor 5 is first transversely moved toward the lifter 18, whereby the pallet 4 on the transfer conveyor 5 is connected to the lifter 18. In this state, the compression-molded article B on the pallet 4 is pushed out onto the lifter 18 by the pusher 8, and the compression-molded article B is transferred from the pallet 4 to the lifter 18, as shown in FIG. 2. When the pusher 8 is returned to its standby position and recedes from the lifter 18, thereafter, the compression-molded article B, along with the lifter 18, is raised to a predetermined height position.

As the lifter 18 ascends, the transfer conveyor 5 also returns to its original position, and the empty pallet 4 on the transfer conveyor 5 is moved onto the standby conveyor 12. Further, the next compression-molded article B, along with the pallet 4 therefor, is supplied from the supply conveyor 2.

A plate-like dividing knife 26 is disposed on the upper surface of the aforesaid main frame 16. The dividing knife 26 extends in the longitudinal direction of the main frame 16. Both side edge portions of the dividing knife 26 are supported for sliding motion with respect to the main frame 16, and the dividing knife 26 can reciprocate within a horizontal plane along the supply conveyor 2. More specifically, a feed screw 28 is located under the dividing knife 26, and the feed screw 28 extends horizontally in the center of the dividing knife 26, having both its ends supported by the main frame 16. The dividing knife 26 and the feed screw 28 are coupled to each other by means of a coupling mechanism, and the feed screw 28 is rotated in the forward and reverse directions by means of a servomotor 30 that is connected to one end thereof.

The dividing knife 26 has a cutting edge. As seen from FIG. 1, the cutting edge is situated on the side of the lifter 18, and has the shape of a V directed toward the lifter 18. More specifically, the dividing knife 26 includes a plate-like knife holder 32 and a pair of blades 34 that form an effective cutting edge region. The knife holder 32 can reciprocates on the aforesaid main frame 16. One end edge of the knife holder 32 is notched in the shape of a V, and the blades 34 are fixed individually to a pair of slanting edges that define the resulting V-shaped notch.

Figure 3:
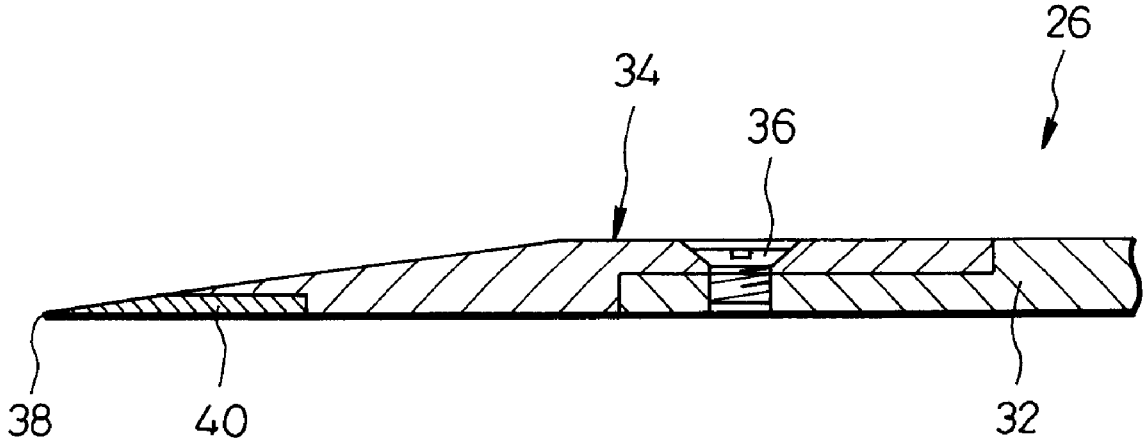
FIG. 3 is a sectional view showing the distal end portion of a dividing knife.

Referring to FIG. 3, there is shown in detail a coupling structure for the knife holder 32 and one of the blades 34. Mating steps are formed on each slanting edge of the knife holder 32 and the ridge portion of each blade 34, individually. Thus, the respective upper and lower surfaces of the plate member 32 and the blade 34 are continuous with one another within the same planes. Although the pair of blades 34 are detachably coupled to the knife holder 32 by means of a plurality of countersunk screws 36, these countersunk screws 36 never project from the upper and lower surfaces of the dividing knife 26. The countersunk screws 36 are arranged alternately in two rows along the blades 34.

As seen from FIG. 3, each blade 34 is wedge-shaped, and its distal end edge is formed as a cutting edge 38. The cutting edge 38 is formed by pressure-welding a plate member 40 of high-speed steel to the ground metal of the blade 34 and then grinding the plate member 40.

When the pair of blades 34 are fixed to the knife holder 32, an angle $\alpha$ (see FIG. 4) between the respective cutting edges 38 of these blades 34 is adjusted to 60 to 120°, and preferably to 70 to 90°. The region in which the respective cutting edges 38 of the pair of blades 34 adjoin each other may be in the shape of a circular arc.

Figure 4:
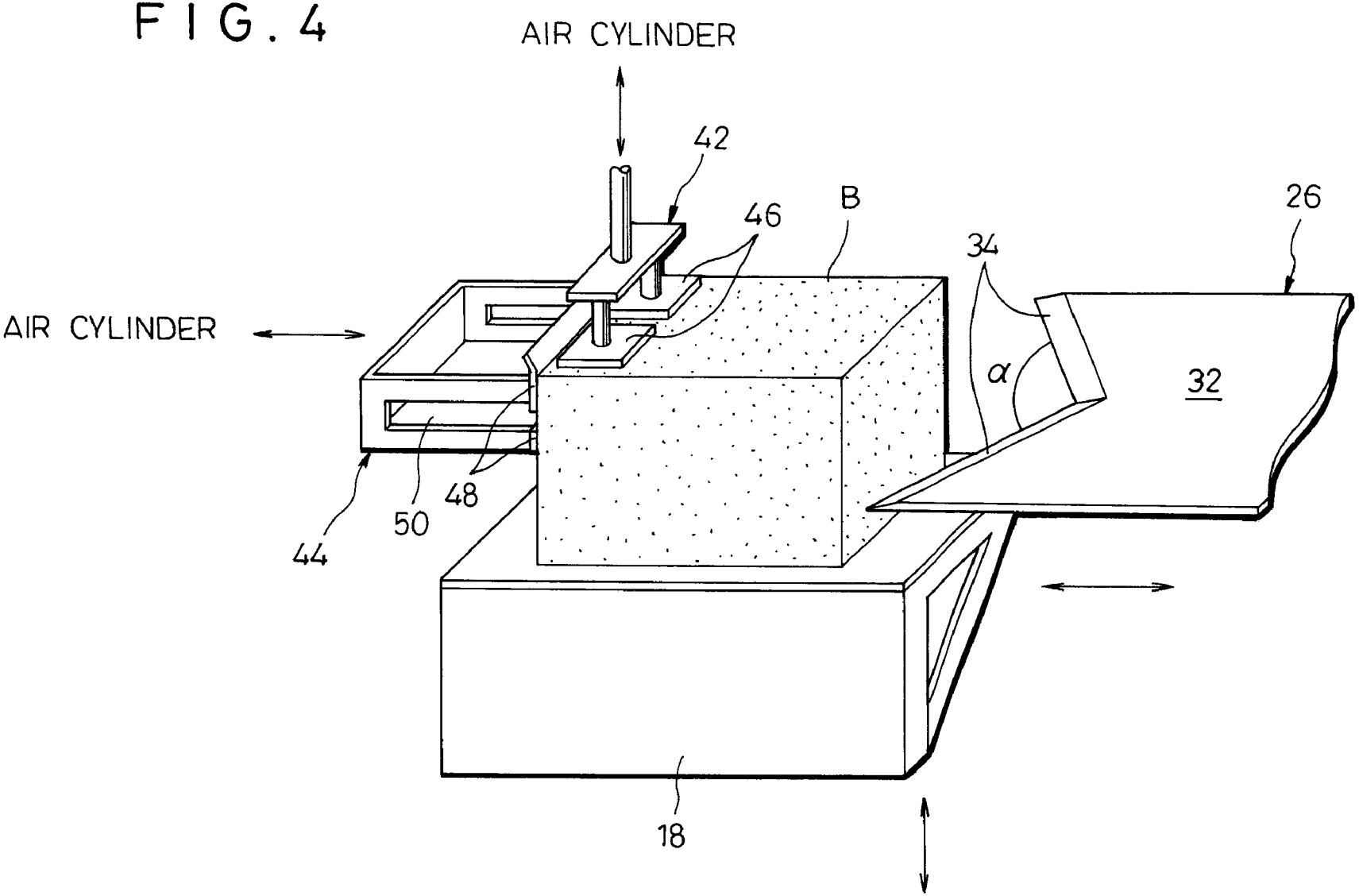
FIG. 4 is a schematic perspective view of the slicing apparatus.

When the lifter 18 is raised together with the compression-molded article B, as mentioned before, the dividing knife 26 is situated in a pause position, where it never prevents the ascent of the compression-molded article B, as shown in FIGS. 1 and 4.

The position to which the lifter 18 is raised is set depending on the size, weight, and number of divisions of the compression-molded article B. More specifically, the lifter 18 is raised so as to position the uppermost target slice surface, among other target slice surfaces of the compression-molded article B, within the same plane of aforesaid dividing knife 26. The weight of the compression-molded article B can be measured on the lifter 18.

When the compression-molded article B is raised together with the lifter 18, an upper presser 42 and a side stopper 44 are pressed against the upper and side surfaces, respectively, of the compression-molded article B, as shown in FIG. 4. The upper presser 42 has a pair of presser pads 46, and these presser pads 46 press down that end portion of the compression-molded article B which is situated on the side opposite from the dividing knife 26 within the upper surface, with a force equivalent to the weight of, e.g., 15 kg.

On the other hand, the side stopper 44 has upper and lower presser pads 48, and these presser pads 48 individually press down that side face of the compression-molded article B which is situated on the slide opposite from the dividing knife 26. Here an opening or escape 50 to allow the penetration of the dividing knife 26 is secured between the presser pads 48.

Figure 5:
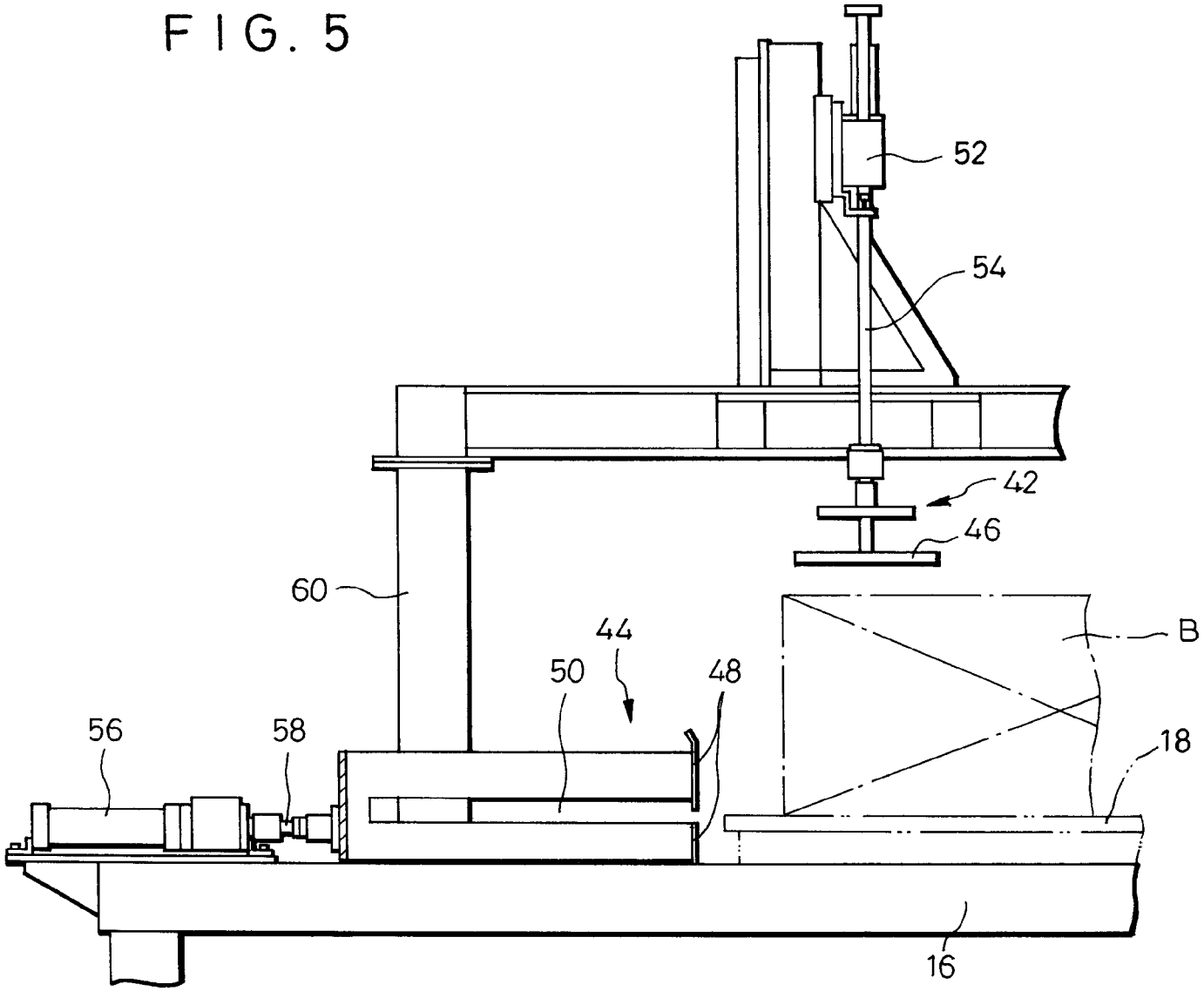
FIG. 5 is a view showing part of the slicing apparatus.

The upper presser 42 is vertically movable toward and away from the upper surface of the compression-molded article B, while the side stopper 44 is horizontally movable toward and away from the side face of the compression-molded article B. More specifically, as shown in FIG. 5, the upper stopper 42 is coupled to a piston rod 54 of a vertical cylinder 52, while the side stopper 44 is coupled to a piston rod 58 of a horizontal cylinder 56. These cylinders 52 and 56 are formed of an air cylinder each. The one cylinder 56 is supported on the aforesaid main frame 16, while the other cylinder 52 is supported on a sub-frame 60 that projects upward from the main frame 16. FIG. 5 shows a state in which the lifter 18 is raised to the maximum.

When the compression-molded article B is in the state shown in FIG. 4, the compression-molded article B is held between the lifter 18 and the upper presser 42, and the side stopper 44 is pressed against the side face of the compression-molded article B. Although the side stopper 44 is pressed against the compression-molded article B, the compression-molded article B never moves on the lifter 18.

Figure 6:
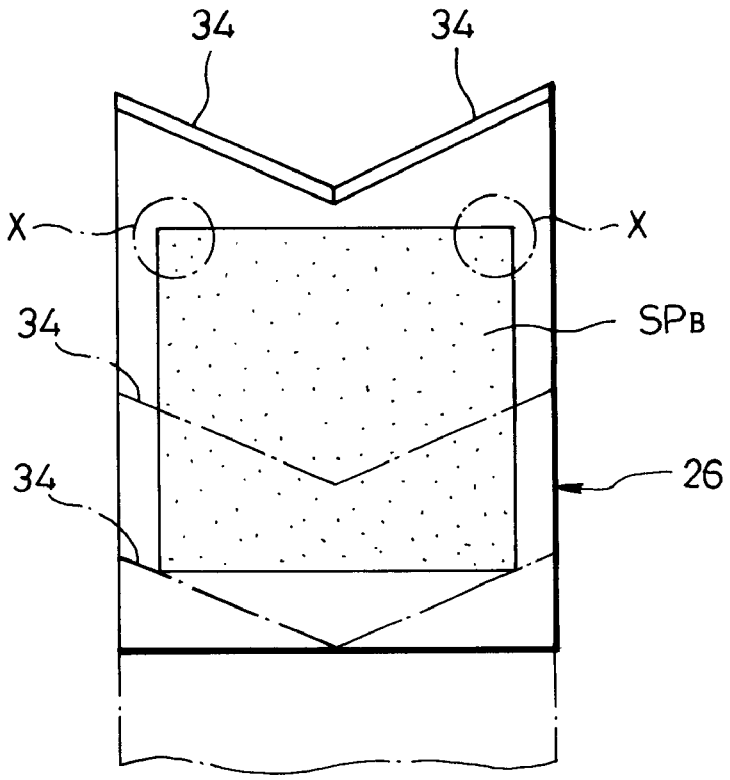
FIG. 6 is a plan view showing a compression-molded article immediately after division.
Figure 7:
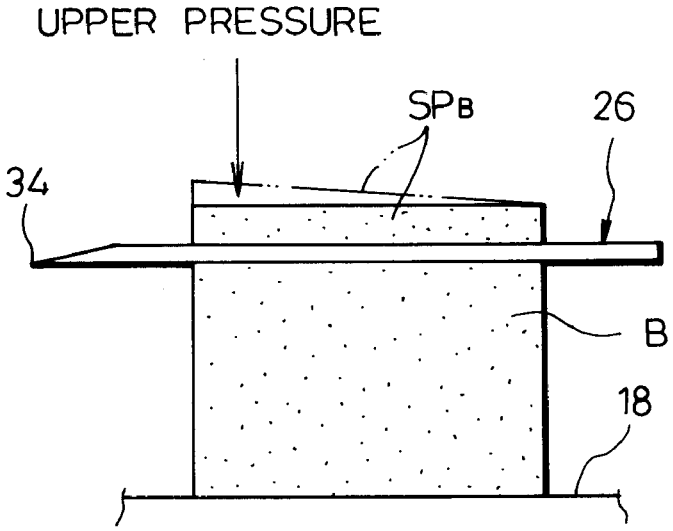
FIG. 7 is a side view showing the compression-molded article immediately after division.

When the dividing knife 26 is moved toward the compression-molded article B in this state, the dividing knife 26 cuts into the compression-molded article B along the target slice surface, with its pair of blades 34 forward. In consequence, a slice piece $SP_B$ is formed on the dividing knife 26, as shown in FIGS. 6 and 7. Here the moving speed of the dividing knife 26 ranges from 50 to 80 m/min, and preferably from 60 to 70 m/min.

When the blades 34 of the dividing knife 26 get out of the compression-molded article B entirely, the blades 34 get into the escape 50 of the side stopper 44, so that the dividing knife 26 never interferes with the side stopper 44. When the blades 34 of the dividing knife 26 reach a predetermined position, this arrival is detected by a limit switch (not shown). At the time of this detection, the advance of the dividing knife 26 is stopped and the dividing knife 26 is held in its slicing position.

As the dividing knife 26 cuts into the compression-molded article B, as indicated by two-dot chain line in FIG. 6, the pair of V-shaped blades 34 advance in the compression-molded article B while holding the compression-molded article B from both sides. Accordingly, the cutting force of the pair of blades 34 acts toward the center of the compression-molded article B, so that the outer periphery of the compression-molded article B, that is, the outer periphery of the slice piece $SP_B$ and the remaining portion of the compression-molded article B, cannot be chipped.

Such chipping is particularly liable to occur in those corner portions of the compression-molded article B which are indicated by dashed-line circles X in FIG. 6 when the pair of blades 34 get out of the compression-molded article B. In other words, the laminae in the corner portions of the compression-molded article B are tied so loosely to the surrounding laminae that the compression-molded article B easily chips in its corner portions, and tobacco material inevitably spills. The corner portions of the compression-molded article B cannot be chipped, however, since the V-shaped blades 34 push in the corner portions of the compression-molded article B toward the center of the compression-molded article B as they get out of the compression-molded article B.

If the blades of the dividing knife are chevron-shaped, on the other hand, the conventional dividing knife is liable to subject the compression-molded article B to a force directed outward from the inside of the compression-molded article B, thereby causing the outer periphery or corner portions of the compression-molded article B to chip, while cutting into the compression-molded article B.

Since the angle α between the pair of blades 34 is adjusted to 60 to 120°, moreover, the dividing knife 26 can satisfactorily divide the compression-molded article B without causing the slicing apparatus to become large-sized. More specifically, in this respect, the cutting angle of the blades 34 for the compression-molded article B will be too narrow if the angle α between the pair of blades 34 is wider than 120°. Therefore, the compression-molded article B can be cut by only pushing the dividing knife 26, so that the cutting is not smooth and entails an increase of swarf.

If the angle α between the pair of blades 34 is narrower than 60°, on the other hand, the pair of blades 34 must be lengthened in order to allow the compression-molded article B between the pair of blades 34. Accordingly, the reciprocation stroke of the dividing knife 26 lengthens, so that the slicing apparatus is large-sized. In this case, the cutting force of the pair of blades 34 to advance into the central portion of the compression-molded article B becomes excessive, so that the slice piece is lifted as it is cut. Consequently, the central portion of the slice piece becomes thicker than the peripheral portion thereof.

For these reasons, the angle α between the pair of blades 34 is set within the range of 60 to 120°. In consideration of the quantity of swarf and the size of the slicing apparatus, the angle α optimally ranges from 70 to 90°.

If the angle α between the pair of blades 34 is within the range of 70 to 90°, these blades 34, that is, the dividing knife 26, can cut the compression-molded article B like scissors, so that the cut surface of the compression-molded article B is smooth.

When the V-shaped blades 34 cut into the compression-molded article B from its outer periphery, that portion of the upper surface of the: compression-molded article B from which the blades 34 get out is pressed by the aforesaid upper presser 42. Therefore, the front side of each blade 34 cannot be cleaved in the compression-molded article B. In consequence, the pair of blades 34 or the dividing knife 26 accurately advances along the target slice surface, so that the thickness of the slice piece $SP_B$ is uniform throughout the area.

In the case where the conventional chevron-shaped dividing knife is used, on the other hand, the front side of the dividing knife 26 is cleaved in the compression-molded article B, as mentioned before. This cleavage causes that portion of the compression-molded article B which is situated ahead of the dividing knife to be lifted, as indicated by two-dot chain line in FIG. 7. As a result, the slice piece $SP_B$ obtained with use of the conventional dividing knife 26 is thicker in its region on the dividing knife leaving side than in its region on the dividing knife cut-into side.

The pair of blades 34 of the dividing knife 26 are detachable. Therefore, the respective cutting edges 38 of the pair of blades 34 can be ground again in a manner such that these blades 34 are disengaged from the knife holder 32.

When the slice piece $SP_B$ is cut out of the compression-molded article B by using the dividing knife 26 as described above, the upper presser 42 and the side stopper 44 return to their respective pause positions, whereupon they separate individually from the slice piece $SP_B$ and the remaining compression-molded article B on the lifter 18.

Figure 8:
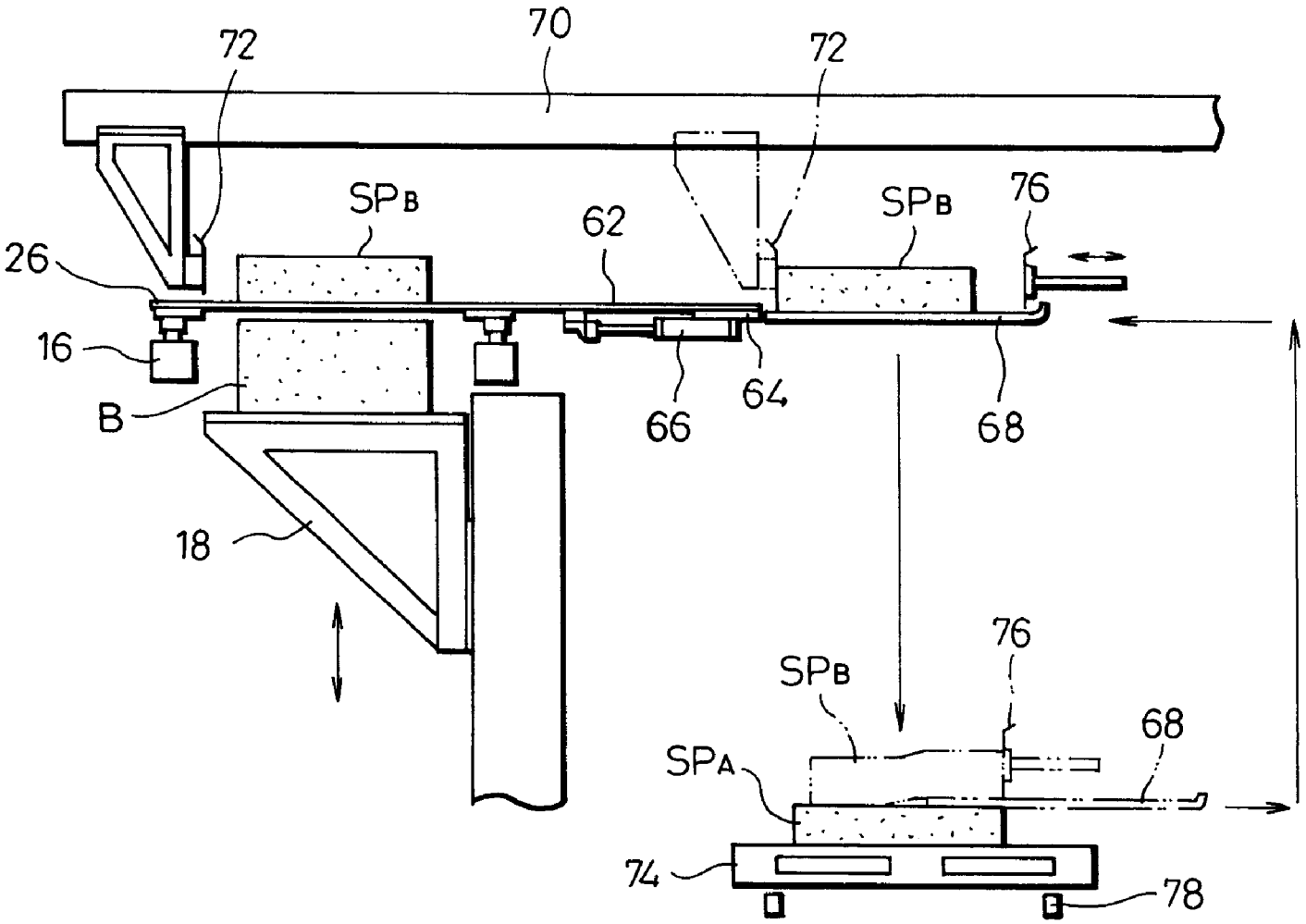
FIG. 8 is a view showing part of a slice layer.

Thereafter, the lifter 18 is slightly lowered, and the compression-molded article B on the lifter 18 is separated from the lower surface of the dividing knife 26, as shown in FIG. 8. When this is done, the slice piece $SP_B$ is held on the dividing knife 26.

As shown in FIG. 8, a connecting plate 62 is located beside the dividing knife 26 in the slicing position. The connecting plate 62 is situated within the same horizontal plane as the dividing knife 26, and is movably supported on a support stage 64. The support stage 64 is mounted on the side of the main frame 16. An air cylinder 66 is located under the support stage 64, and the air cylinder 66 couples the support stage 64 and the lower surface of the connecting plate 62 to each other. The air cylinder 66 can move the connecting plate 62 toward and away from the dividing knife 26.

Further a stack plate 68 is located beside the connecting plate 62, and the stack plate 68 is movable in the vertical and horizontal directions. When in the state shown in FIG. 8, the stack plate 68 is situated in its up position. The up position of the stack plate 68 is a little lower than the connecting plate 62.

A guide rail 70 is located over the dividing knife 26, and the guide rail 70 extends horizontally to a position over the stack plate 68. A piece pusher 72 is attached to the guide rail 70, and the piece pusher 72 can reciprocate along the guide rail 70. The piece pusher 72 is reciprocated by using a feed screw (not shown) that is rotate in the forward and reverse directions by means of a servomotor.

When the slice piece $SP_B$ is held on the dividing knife 26, as mentioned before, the connecting plate 62 is advanced toward the dividing knife 26 by the air cylinder 66, and is connected to a side edge of the dividing knife 26. At this time, the stack plate 68 is in its up position. Thus, the dividing knife 26 is connected to the stack plate 68 by means of the connecting plate 62, as shown in FIG. 8.

When the piece pusher 72 is moved from its pause position toward the stack plate 68 in this state, the piece pusher 72 pushes the slice piece $SP_B$ on the dividing knife 26. Thereupon, the slice piece $SP_B$ is transferred to the surface of the stack plate 68. As the slice piece $SP_B$ passes on the connecting plate 62 at this time, the width of the slice piece $SP_B$ in the transfer direction of the slice piece $SP_B$ is measured by means of a measurer (not shown).

When the slice piece $SP_B$ is transferred to the surface of the stack plate 68, the dividing knife 26 returns from the slice position to the pause position, and the piece pusher 72 also returns from the surface of the stack plate 68 to the pause position.

Thereafter, the compression-molded article B remaining on the lifer 18 is raised together with the lifter 18 so that the next target slice surface of the compression-molded article B is situated in the same height position as the dividing knife 26. After the slice piece $SP_B$ descends together with the stack plate 68, on the other hand, the connecting plate 62 returns to a retreated position on the side of the stack plate 68.

When the compression-molded article B on the lifter 18 thus ascends, thereby causing the connecting plate 62 to return to the retreated position, the dividing knife 26 is allowed to slice the compression-molded article B in like manner.

As shown in FIG. 8, a stack pallet 74 is located under the up position of the stack plate 68. When the slice piece $SP_B$ is lowered together with the stack plate 68 in the aforesaid manner, therefore, the slice piece $SP_B$ is placed on the stack pallet 74 by means of the stack plate 68. In the state of FIG.

8, more specifically, a slice piece $SP_A$ is already placed on the stack pallet 74. In this case, the slice piece $SP_B$ is placed on the slice piece $SP_A$ by means of the stack plate 68. Here the slice piece $SP_A$ is a slice piece that is obtained by dividing the compression-molded article A, which is different from the compression-molded article B, in a preceding slice batch process, and the compression-molded articles A and B are different in the breed and grade of their laminae.

The stack plate 68 is provided with a piece stopper 76 that can reciprocate. When the stack plate 68 is in the up position, the piece stopper 76 is situated in its retreated position. When the stack plate 68 receives the slice piece $SP_B$, therefore, the piece stopper 76 is off the slice piece $SP_B$ on the stack plate 68. When the stack plate 68, accompanied with the slice piece $SP_B$, is placed on the slice piece $SP_A$ on the stack pallet 74, however, the piece stopper 76 moves from the retreated position to its advanced position and is caused to engage the slice piece $SP_B$.

In this state, the stack plate 68 retreats, as indicated by two-dot chain line in FIG. 8, and is drawn out from between the slice pieces $SP_A$ and $SP_B$, whereupon the slice piece $SP_B$ is superposed on the slice piece $SP_A$. Since the piece stopper 76 is in contact with the slice piece $SP_B$ when the stack piece 68 is drawn out, the slice piece $SP_B$ never moves dragged by the stack plate 68.

Thereafter, the piece stopper 76 returns to the retreated position. The stack plate 68 ascends together with the piece stopper 76 and advances to the aforesaid up position. In this up position, the stack plate 68 gets under the connecting plate 62, and the stack plate 68 and the connecting plate 62 partially overlap each other.

The aforesaid stack pallet 74 is located on a circulating conveyor 78, and the layout of this circulating conveyor 78 is shown in FIG. 1. An entrance conveyor 80 is connected to the circulating conveyor 78, and the entrance conveyor 80 can supply the stack pallet 74 to the circulating conveyor 78, and on the other hand, receive the stack pallet 74 from the circulating conveyor 78.

As shown in FIG. 1, a plurality of stack pallets 74 is fed onto the circulating conveyor 78. These stack pallets 74 are successively situated in a stacking position, that is, a position under the stack plate 68 in the up position, where they can receive the slice pieces in the aforesaid manner.

More specifically, in connection with this, the stack pallet 74, having the slice piece $SP_B$ placed thereon in the aforesaid manner in the stacking position, is transported on the circulating conveyor 78 from the stacking position, and the next stack pallet 74 is situated in the stacking position. Thereafter, a slice piece $SP_B$ cut out of the compression-molded article B in like manner is stacked on the next stack pallet 74.

As the aforementioned operation is repeated, the slice pieces $SP_B$ cut out of the compression-molded article B are distributed to and stacked on their corresponding stack pallets 4.

During the division of the compression-molded article B, the compression-molded article finally remaining on the lifter 18, that is, the last slice piece SP, is transferred from the lifter 18 to the surface of the stack plate 68.

Figure 9:
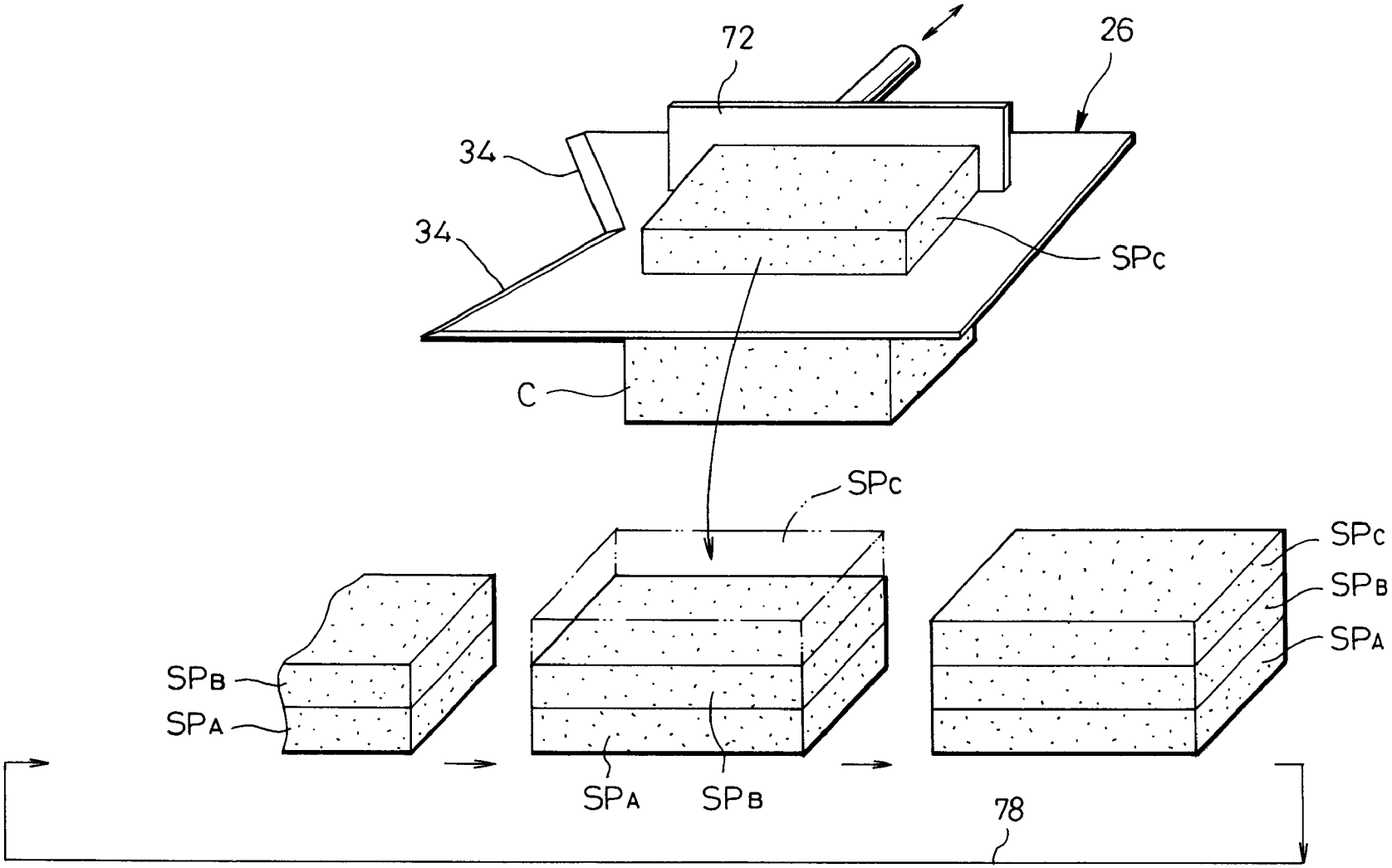
FIG. 9 is a plan view showing steps of procedure from division of a compression-molded article to stacking of slice pieces.

Referring to FIG. 9, there are clearly shown steps of procedure from division of a compression-molded article to stacking of slice pieces, that is, the way slice pieces divided from various compression-molded articles are successively stacked on each stack pallet 74. A stack obtained by stacking the slice pieces in layers, along with the stack pallet 74, is discharged from the circulating conveyor 78 onto the entrance conveyor 80, and then fed from this entrance conveyor 80 to the next process.

The present invention is not limited to the one embodiment described above, and various modifications may be effected therein. For example, the cutting edge of the dividing knife is not bound to be V-shaped, and may alternatively be substantially W-shaped (FIG. 10), spread-U-shaped (FIG. 11), or circular-arc-shaped (FIG. 12)

Figure 10:
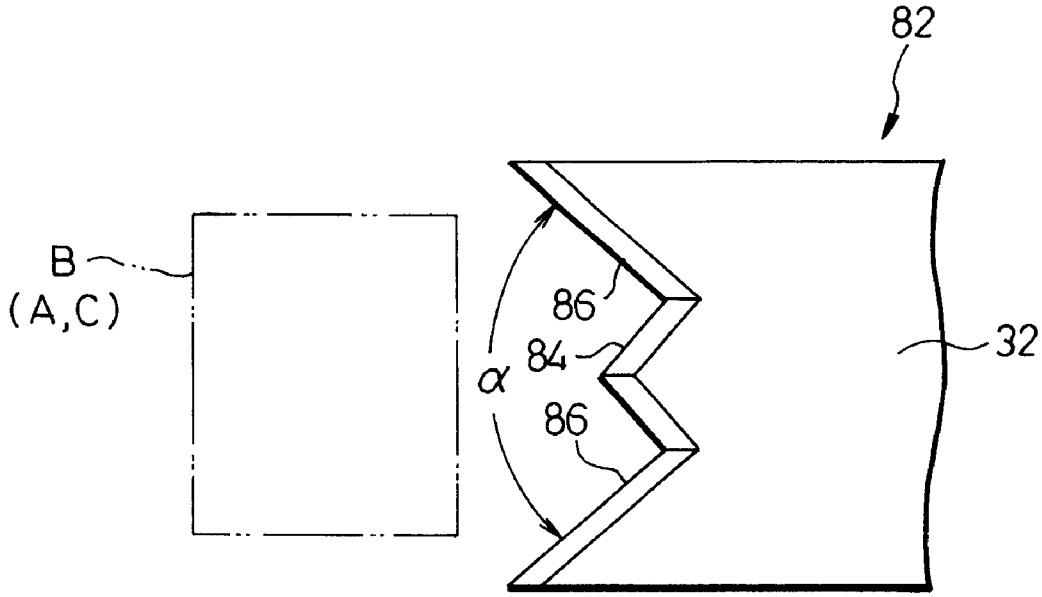
FIG. 10 is a plan view showing another dividing knife.

In the case of a dividing knife 82 of FIG. 10, a chevron-shaped center blade 84 in the center is recessed behind side blades 86 on either side. Although it has the chevron-shaped center blade 84, the dividing knife 82 of FIG. 10 can fulfil the same cutting function of the aforementioned dividing knife 26. Owing to the presence of the center blade 84, moreover, the dividing knife 82 is further improved in compression-molded article cutting capability, and can provide smooth cut surfaces. Here the angle between the pair of side blades 86 is set at the aforesaid $\alpha$.

Figure 11:
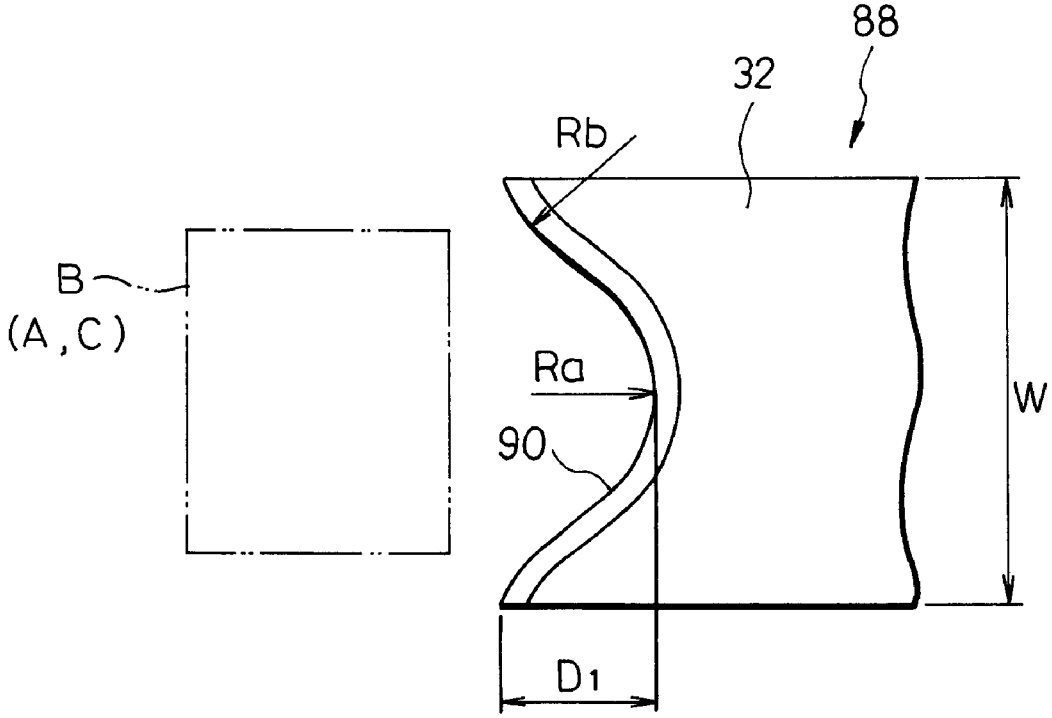
FIG. 11 is a plan view showing another dividing knife.
Figure 12:
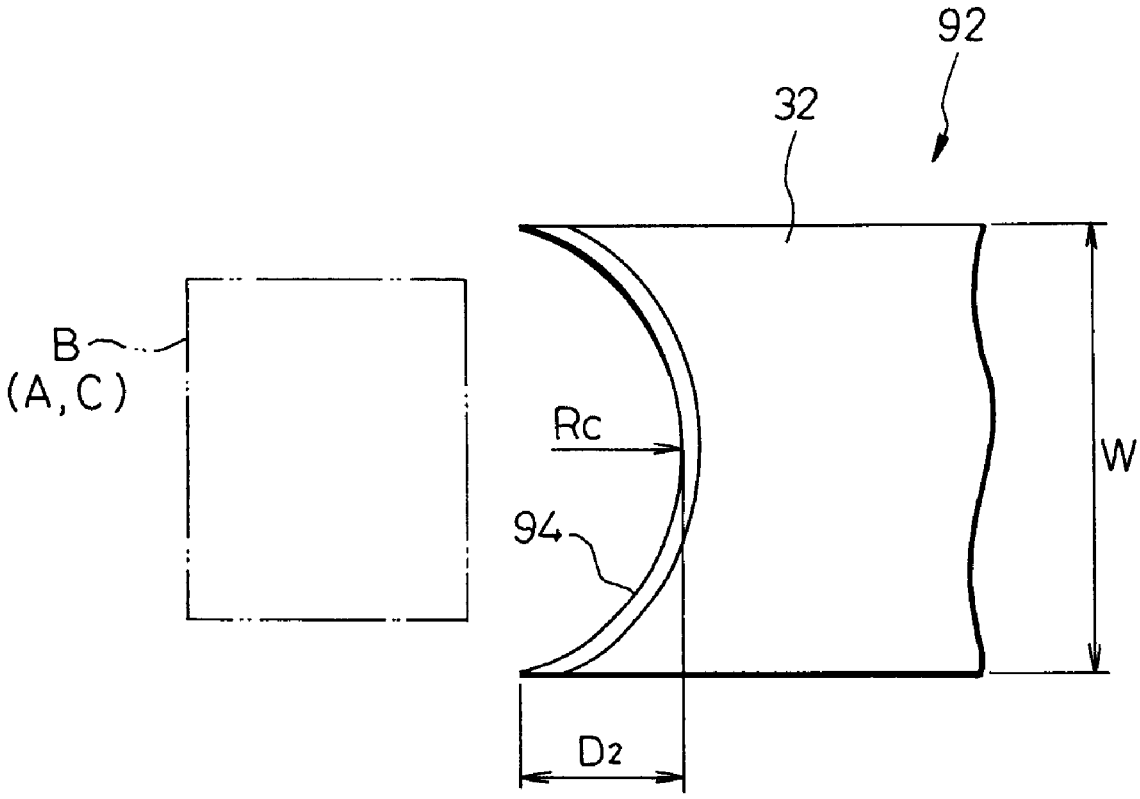
FIG. 12 is a plan view showing another dividing knife.

In the case of a dividing knife 88 of FIG. 11, the following relations are satisfied:

$$0<D_1\leqq W/2,\ 0<Ra\leqq W/2,\ W2\leqq Rb,$$

where $D_1$ is the depth of its blade 90, Ra and Rb are the respective radii of curvature of its central portion and opposite end portions, and W is the width of the dividing knife 88.

In the case of a dividing knife 92 of FIG. 11, the following relation is satisfied:

$$D_2<Rc,$$

where $D_2$ and Rc are the depth and the radius of curvature, respectively, of a blade 94.

Further, the slicing apparatus and the dividing knife described above are not limited to the use for compression-molded articles of laminae, and may be used for the division of compression-molded articles that are molded by compressing various sheet materials.

What is claimed is:

1. An apparatus for slicing a compression-molded article of sheet-like materials, comprising:

ascending/descending means including a lifter for receiving the compression-molded article of the sheet-like materials and used to raise and lower said compression-molded article together with the lifter;

dividing means for dividing the compression-molded article on said lifter into a first piece with a given thickness and a second piece, said dividing means including a dividing knife capable of moving toward said lifter in a first direction along a straight line and within a horizontal plane, thereby cutting the compression-molded article on said lifter, said dividing knife including an effective cutting edge region recessed with respect to said compression-molded article obtained by cutting; and discharge means for discharging said first piece from the upper surface of said dividing knife in a second direction substantially perpendicular to said first direction to a position beside said dividing knife.

2. The apparatus according to claim 1, wherein said dividing means further comprises upper presser means for pressing an upper surface of said compression-molded article when said compression-molded article is cut.

3. The apparatus according to claim 2, wherein said upper presser means is located above a portion of said upper surface which is situated on a side through which said dividing knife exits said compression-molded article.

4. The apparatus according to claim 1, wherein said dividing means further includes side stopper means for pressing a side face of said compression-molded article which is situated on a side through which said dividing knife exits said compression-molded article.

5. A dividing knife capable of horizontally moving toward a compression-molded article of sheet-like materials, thereby dividing said compression-molded article into pieces with a given thickness, the dividing knife including an effective cutting edge region having a central portion recessed with respect to outermost side edge portions of said effective cutting edge region such that said central portion is located further from said compression-molded article than said outermost side edge portions, wherein said effective cutting edge region of said dividing knife is V-shaped with respect to said compression-molded article.

6. The dividing knife according to claim 5, wherein said effective cutting edge region has an angle of 60 to 120°.

7. A dividing knife capable of horizontally moving toward a compression-molded article of sheet-like materials, thereby dividing said compression-molded article into pieces with a given thickness, the dividing knife including an effective cutting edge region having a central portion recessed with respect to outermost side edge portions of said effective cutting edge region such that said central portion is located further from said compression-molded article than said outermost side edge portions, wherein said effective cutting edge region of said dividing knife is W-shaped with respect to said compression-molded article and has a chevron-shaped cutting edge portion in the center recessed behind opposite ends of cutting edge portions on either side.

8. An apparatus for slicing a compression-molded article of sheet-like materials, comprising:

a lifter for receiving the compression-molded article of the sheet-like materials and for raising and lowering said compression-molded article;

a dividing knife for dividing the compression-molded article on said lifter into a first piece with a substantially uniform thickness and a second piece, said dividing knife movable toward said lifter in a first direction along a straight line from a retracted position where said dividing knife has not penetrated said compression-molded article to an extended position where said dividing knife has passed through said compression-molded article, thereby cutting the compression-molded article on said lifter, said dividing knife further including an upper surface for holding the first piece of said compression-molded article obtained by cutting; and a discharge member for discharging said first piece from the upper surface of said dividing knife in a. second direction substantially perpendicular to said first direction to a position beside said dividing knife.

9. The apparatus according to claim 8, further comprising an upper presser device for pressing an upper surface of said compression-molded article when said compression-molded article is cut.

10. The apparatus according to claim 9, wherein said upper presser device is located above a portion of said upper surface which is situated on a side through which said dividing knife exits said compression-molded article.

11. The apparatus according to claim 8, further comprising at least one side stopper for pressing a side face of said compression-molded article which is situated on a side through which said dividing knife exits said compression-molded article.

12. The apparatus according to claim 8, wherein said dividing knife includes a cutting edge with a central portion recessed with respect to outermost side edge portions thereof such that said central portion is located further from said compression-molded article than said outermost side edge portions when said dividing knife is in said retracted position.

13. The apparatus according to claim 12, wherein said cutting edge of said dividing knife is V-shaped with respect to said compression-molded article.

14. The apparatus according to claim 13, wherein said cutting edge has an angle of 60° to 120°.

15. The apparatus according to claim 12, wherein said cutting edge of said dividing knife is W-shaped with respect to said compression-molded article and has a chevron-shaped cutting edge portion in the center recessed behind opposite ends of cutting edge portions on either side.

16. The apparatus according to claim 12, wherein said cutting edge of said dividing knife has the shape of a U spread toward said compression-molded article.

17. The apparatus according to claim 12, wherein said cutting edge of said dividing knife has the shape of a circular arc with respect to said compression-molded article.

* * * * *